US008433625B1

(12) United States Patent
Sarma

(10) Patent No.: US 8,433,625 B1
(45) Date of Patent: Apr. 30, 2013

(54) GEOGRAPHICAL PREFERENCES

(75) Inventor: Subramonia P. Sarma, Bellevue, WA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 12/816,405

(22) Filed: Jun. 16, 2010

(51) Int. Cl.
*G06Q 30/00* (2006.01)

(52) U.S. Cl.
USPC ..... 705/27.1

(58) Field of Classification Search ..... 705/10, 705/14, 26–27
See application file for complete search history.

(56) References Cited

U.S. PATENT DOCUMENTS

| | | | | |
|---|---|---|---|---|
| 7,263,494 | B1 * | 8/2007 | Harris | 705/5 |
| 7,418,410 | B2 * | 8/2008 | Caiafa | 705/26.61 |
| 7,548,915 | B2 * | 6/2009 | Ramer et al. | 1/1 |
| 7,577,665 | B2 * | 8/2009 | Ramer et al. | 1/1 |
| 7,603,360 | B2 * | 10/2009 | Ramer et al. | 1/1 |
| 2003/0028451 | A1 * | 2/2003 | Ananian | 705/27 |
| 2006/0155609 | A1 * | 7/2006 | Caiafa | 705/26 |
| 2006/0178932 | A1 * | 8/2006 | Lang | 705/14 |
| 2007/0174259 | A1 * | 7/2007 | Amjadi | 707/3 |
| 2007/0179869 | A1 * | 8/2007 | Cochrum | 705/29 |
| 2007/0226082 | A1 * | 9/2007 | Leal | 705/27 |
| 2008/0040220 | A1 * | 2/2008 | Levy et al. | 705/14 |
| 2009/0094235 | A1 * | 4/2009 | White et al. | 707/5 |
| 2010/0094681 | A1 * | 4/2010 | Almen et al. | 705/10 |
| 2010/0114739 | A1 * | 5/2010 | Johnston | 705/27 |

OTHER PUBLICATIONS

Dunsford, H., "Design and Development of an Extensible, Interchangeable Component Architecture for Open-Source Geographic Information Systems" (Idaho State University, May 2010).*

* cited by examiner

*Primary Examiner* — Jeffrey A Smith
*Assistant Examiner* — Ethan D Civan
(74) *Attorney, Agent, or Firm* — Thomas|Horstemeyer, LLP.

(57) ABSTRACT

Disclosed are various embodiments for using geographic areas to filter items in an electronic commerce system. A catalog of items is stored in a data store accessible by one or more computing devices. A geographical filtering process is provided that is executable in the one or more computing devices. The geographical filtering process comprises logic that obtains a specification of at least one geographical area, and logic that identifies a subset of the items based at least in part upon a plurality of past commercial transactions associated with the items occurring within the at least one geographical area.

29 Claims, 6 Drawing Sheets

GEOGRAPHICAL PREFERENCES

BACKGROUND

Various trends with respect to product purchasing may occur in different areas or regions throughout the world. In one example, fashion trends can vary widely from place to place. For example, in a warm tropical island environment, fashions or preferences may differ from those in colder environment. In the United States, fashion may vary significantly, for example, between a city in the West such as Denver, and a city in the East such as Boston.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

The various embodiments of the present disclosure provide customers with the ability to view various listings of items in association with one or more selected geographical areas. For example, a customer may specify that they wish to view the top selling items within a given city, state, or other geographical area. In the following discussion, a general description of the system and its components is provided, followed by a discussion of the operation of the same.

Figure 1:
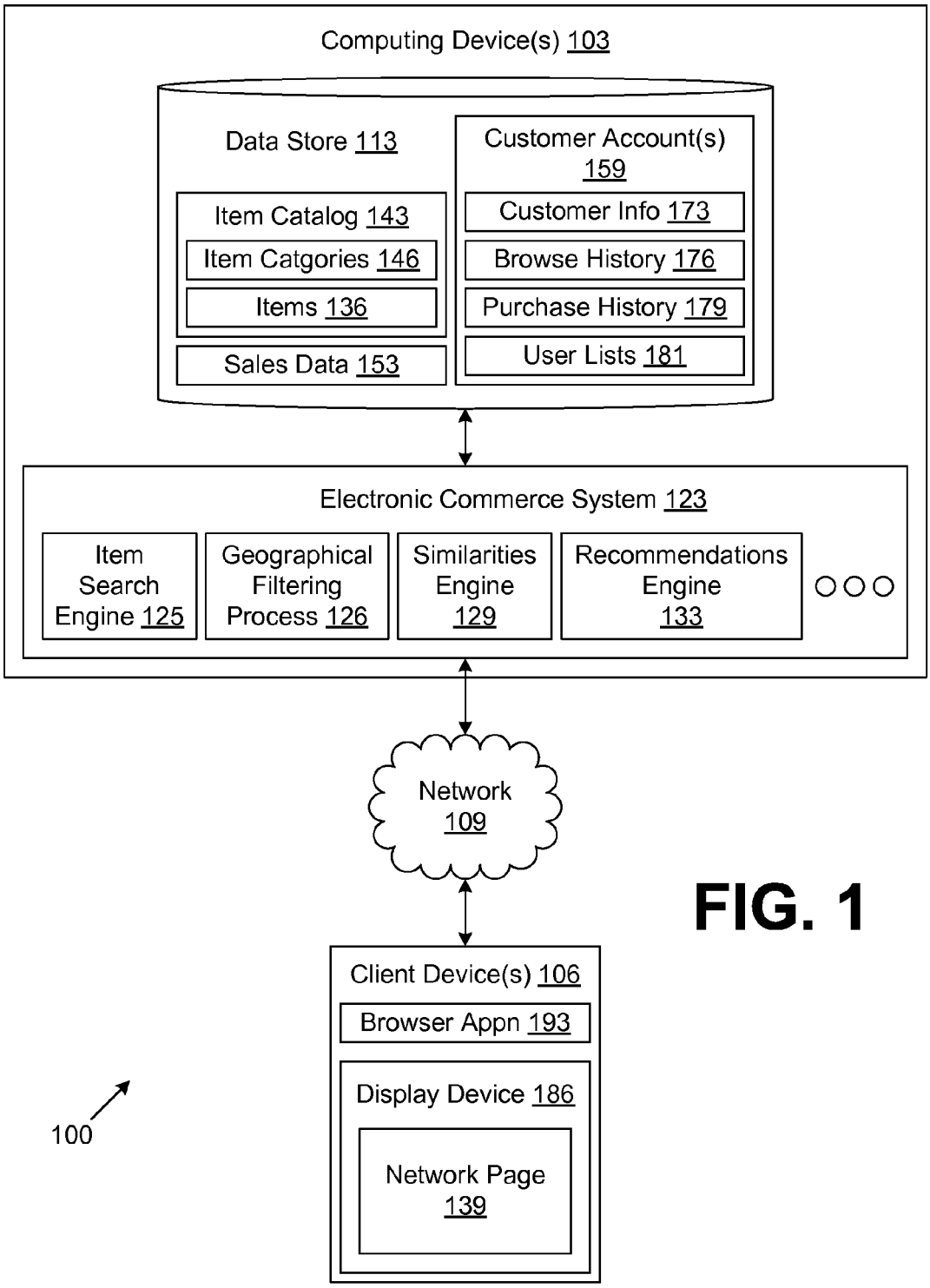
FIG. 1 is a drawing of a networked environment according to various embodiments of the present disclosure.

With reference to FIG. 1, shown is a networked environment 100 according to various embodiments. The networked environment 100 includes one or more computing devices 103 and one or more client devices 106, each of which is coupled to a network 109. The network 109 includes, for example, the Internet, intranets, extranets, wide area networks (WANs), local area networks (LANs), wired networks, wireless networks, or other suitable networks, etc., or any combination of two or more such networks.

The computing device 103 may comprise, for example, a server computer or any other system providing computing capability. Alternatively, a plurality of computing devices 103 such as multiple servers may be employed that are arranged, for example, in one or more server banks or computer banks or other arrangements. For example, a plurality of computing devices 103 together may comprise a cloud computing resource, a grid computing resource, and/or any other distributed computing arrangement. Such computing devices 103 may be located in a single installation or may be dispersed among many different geographical locations. For purposes of convenience, the computing device 103 is referred to herein in the singular. Even though the computing device is referred to in the singular, it is understood that a plurality of computing devices 103 may be employed in the various arrangements as described above.

Various applications and/or other functionality may be executed in the computing device 103 according to various embodiments. Also, various data is stored in a data store 113 that is accessible to the computing device 103. The data store 113 may be representative of a plurality of data stores as can be appreciated. The data stored in the data store 113 is associated, for example, with the operation of the various applications and/or functional entities described below.

The components executed on the computing device 103, for example, include an electronic commerce system 123 and other applications, services, processes, systems, engines, or functionality not discussed in detail herein. The electronic commerce system 123 includes various components such as an item search engine 125, a geographical filtering process 126, a similarities engine 129, a recommendations engine 133, and other applications and processes.

The electronic commerce system 123 is executed in order to facilitate the online purchase of items 136 over the network 109. The electronic commerce system 123 also performs various back-end functions associated with the online presence of a merchant in order to facilitate the online purchase of items 136. For example, the electronic commerce system 123 generates user interfaces and/or network pages 139 such as web pages or other types of network content that are provided to client devices 106 for the purposes of selecting items for purchase, rental, download, lease, or other form of consumption as will be described.

The electronic commerce system 123 is configured to facilitate selection of items 136 from an item catalog 143. The items 136 in the item catalog 143 may be organized into various item categories 146. The item search engine 125 is employed to search the item catalog 143 to find items 136 responsive to search terms or other inputs by users. The items 136 responsive to a search may be presented to a user in a search results network page 139 that facilitates the selection of items 136.

The geographical filtering process 126 is employed to facilitate a specification of one or more geographical areas by a customer. The one or more geographical areas are then employed to identify subset of the items 136 in the item catalog 143 based at least in part upon past commercial transactions involving the items 136 that occurred within the specified one or more geographical areas. For example, the subset of items 136 identified may comprise the best selling products within the one or more geographical areas as will be discussed.

The similarities engine 129 generates a listing of items 136 that are similar to or are related to one or more specified items 136. One may obtain a listing of products similar to a predefined product by sending a request for similarities to the similarities engine 129 that identifies the item 136 for which similarities are desired. The recommendations engine 133 generates item recommendations for customers based on various information about the customer, or information from other sources. Both the similarities identified by the similarities engine 129 and the recommendations generated by the recommendations engine 133 may operate in association with the geographical filtering process 126 so that the similarities and/or recommendations generated relate to the one or more geographical areas selected as will be described. In addition, there may be many other components that make up the electronic commerce system 123 that are not discussed herein in detail.

The data stored in the data store 113 includes, for example, the item catalog 143 of items 136, sales data 153, customer accounts 159, and potentially other data. Associated with each customer account 159 are customer information 173, a browse history 176, a purchase history 179, user lists 181, and potentially other data.

The item catalog 143 comprises a catalog of items 136 that are sold by merchants through the electronic commerce system 123. The electronic commerce system 123 provides for the online presence of the merchant on the network 109 such as through a website or other portal as can be appreciated. Associated with each of the items 136 in the item catalog 143 is a detailed description and other information that is presented to customers when viewing such items 136 during interaction with the electronic commerce system 123.

The sales data 153 includes data about past sales transactions conducted through the electronic commerce system 123. Each transaction memorialized in the sales data 153 includes an indication as to the item(s) 136 purchased, the date of purchase, and the billing/shipping addresses, etc. Accordingly, each of the sales transactions stored in the sales data 153 can be linked or associated with a given geographical area based on the billing and/or shipping addresses, or other information maintained about such sales transactions.

A customer account 159 exists for each of the customers who purchase items 136 through the electronic commerce system 123. The customer information 173 associated with each customer account 159 includes various information about the customer such as, for example, customer name, billing addresses, shipping addresses, payment instruments, wish lists, shopping carts, and other information. The browse history 176 includes information about the network pages 139 or other content viewed by the customer in the past while interacting with the electronic commerce system 123 in making purchases, "window shopping," or performing other tasks. The purchase history 179 includes information about the past purchases made by a given customer through the electronic commerce system 123. The user lists 181 comprise lists of items 136 maintained by a user for various purposes. Such user lists 181 may comprise, for example, wish lists, virtual shopping carts, item registries, or other types of lists. In addition, there may be other data stored in the data store 113 associated with customers and other entities as can be appreciated.

The client device 106 is representative of a plurality of client devices that may be coupled to the network 109. The client device 106 may comprise, for example, a processor-based system such as a computer system. Such a computer system may be embodied in the form of a desktop computer, a laptop computer, a personal digital assistant, a cellular telephone, set-top box, music players, web pads, tablet computer systems, or other devices with like capability.

The client device 106 may be configured to execute various applications such as a browser application 193 and/or other applications. The browser application 193 may be executed in a client device 106, for example, to access and render network pages 139, such as web pages, or other network content served up by the computing device 103 and/or other devices or servers. Such network pages 139 or other content may be rendered on a display device 186 associated with the client device 106. The client device 106 may be configured to execute applications beyond browser application 193 such as, for example, email applications, instant message applications, and/or other applications.

Next, a general description of the operation of the various components of the networked environment 100 is provided. Individuals who purchase items 136 through the electronic commerce system 123 may perform various searches for items 136 using various search terms or may specify various item categories 146 to identify items 136 they wish to view in respective network pages 139 in order to select one or more items 136 for purchase. When viewing such network pages 139, individuals may select items 136 that are placed in a shopping cart that may ultimately be purchased through a check-out process as can be appreciated.

As the result of performing a search or identifying an item category 146 to identify items 136 as mentioned above, a network page 139 is presented to a user to view the items 136. The order in which such items 136 appear in the network page 139 may be specified by the customer by manipulating an appropriate graphical component of the network page 139 as will be described. For example, a user may specify that items 136 be listed from the highest priced to the lowest priced or vice versa. Alternatively, the items 136 displayed may be ranked from the best selling to the worst selling, or based upon customer reviews received for such items 136.

According to various embodiments, when viewing a plurality of items 136 as such, a user interface may be presented in a network page 139 that facilitates an input of a specification of one or more geographical areas that may be used to further limit items 136 currently viewed, where such items 136 are responsive to a current search or category specification as mentioned above. Initially, before one or more geographical areas are specified, the items 136 are listed without regard to geographical limitations as will be described. To obtain the user interface, a request is generated and sent to the electronic commerce system 123 on the computing device 103 based on an action at the client device 106. After the user interface is received by the client device 106, the customer may input one or more geographical areas. Once the geographical areas have been input, they are sent to the electronic commerce system 123 to be used to identify those items 136 that are to be displayed in the network page 139.

To provide one example, assume that a user wishes to identify the best selling items in the state of Washington in the United States for a given item category 146. The user may specify the state of Washington as the geographical area to be considered and may request a list of the best selling items 136 in the respective item category 146. The geographical area is sent to the electronic commerce system 123. In response, the geographical filtering process 126 of the electronic commerce system 123 proceeds to find a list of a predefined number of the best selling items 136 from the item category 146. Ultimately, the items 136 are identified and included in a network page 139 and may be ranked according to the number of sales occurring for such items 136 in the specified geographical area. Such a network page 139 is sent to the client device 106 to be rendered on the display device 186. Thus, by specifying a given geographical area, a customer is able to see the best selling items 136 in such geographical area.

This approach recognizes that the popularity of items 136 may differ from one geographical area to the next. Such variation may be due to the preferences of local populations, the nature of the lifestyle in such locations, and other considerations. Also, if a user specified that they wish to see the items 136 ranked in accordance with customer reviews, then the specification of a geographical area by a customer would identify those areas for which such reviews would be considered. In such a case, the items 136 viewed may be ranked in accordance with reviews from a predefined geographical area, where items 136 may have reviews submitted from customers both inside and outside the specified geographical area. Thus, a given geographical area may be used to identify a subset of items 136 that are displayed, as well as the information associated with such items 136 (e.g. reviews) that may be used to rank such items 136 for viewing in a network page 139.

In one embodiment, the geographical area specified may comprise a single area or multiple areas. Such areas may or may not be adjacent to one another. In addition, it may be possible to select individual geographical areas and specify that a total geographical area to be considered excludes those geographical areas specified.

Thus, the various embodiments assume that a predefined relationship exists between the respective items 136 identified in a subset of all the items 136 in the item catalog 143 and the one or more geographical areas selected. Such predefined relationship may comprise, for example, whether such items 136 were the subject of commercial transactions that occurred at least partly or wholly in the respective geographical areas. As mentioned above, a commercial transaction may be deemed to have occurred in a given geographical area if a shipping address or billing address associated with the transaction is located in such area as can be appreciated. This may especially be the case if the shipping and/or billing address, or both, comprises a residential address where a customer resides.

The predefined relationship between respective items 136 and one or more geographical areas selected may be defined, for example, by a link between customers or users that reside in or are otherwise associated with the one or more geographical areas and the respective items 136. An association may be deemed to exist between a user and a specified geographical area, for example, if the user resides in the area as indicated by the respective customer information 173, if an IP address of the user is located in the area, if the user specifies a delivery or payment address in the area, or based upon some other affiliation with a given area.

For example, the predefined relationship between respective items 136 and one or more geographical areas selected may be defined by the fact that customers or users located in such geographical areas include the respective items 136 in one or more user lists 181 maintained in association with the electronic commerce system 123 as mentioned above. That is to say, the widespread storage of items 136 in user lists 181 such as, for example, wish lists, virtual shopping carts, registries, and the like in specified geographical areas may indicate an affiliation between such items 136 and the geographical areas, thereby indicating a predefined relationship between the items 136 and the one or more geographical areas.

Also, the predefined relationship between respective items 136 and one or more geographical areas selected may be defined, for example, by the fact that customers or users located in such geographical areas have viewed such items 136 as indicated by their respective browse histories 176. Specifically, the degree to which customers or users in one or more geographical areas browse or otherwise view items 136 during interaction with the electronic commerce system 123 may indicate the degree to which there is an affiliation between such items 136 and the one or more geographical areas. As such, the predefined relationship may entail the fact that items 136 are viewed by users interacting with the electronic commerce system 123 at least a threshold number of times, where such users reside or are otherwise linked to the one or more geographical areas.

In addition, other types of predefined relationships between items 136 and specified geographical areas may be identified based upon the behavior of respective customers or users.

In addition, each of the network pages 139 depicts various graphical components that may be manipulated to implement various functions as will be described. Such graphical components may comprise, for example, links, buttons, pick lists, menus, drop down menus, toggles, text fields, or other components. Where a specific type of graphical component is shown and/or described, it is understood that such graphical components are merely presented herein as one example of the many different types of graphical components that could be employed to accomplish the same purpose.

Figure 2:
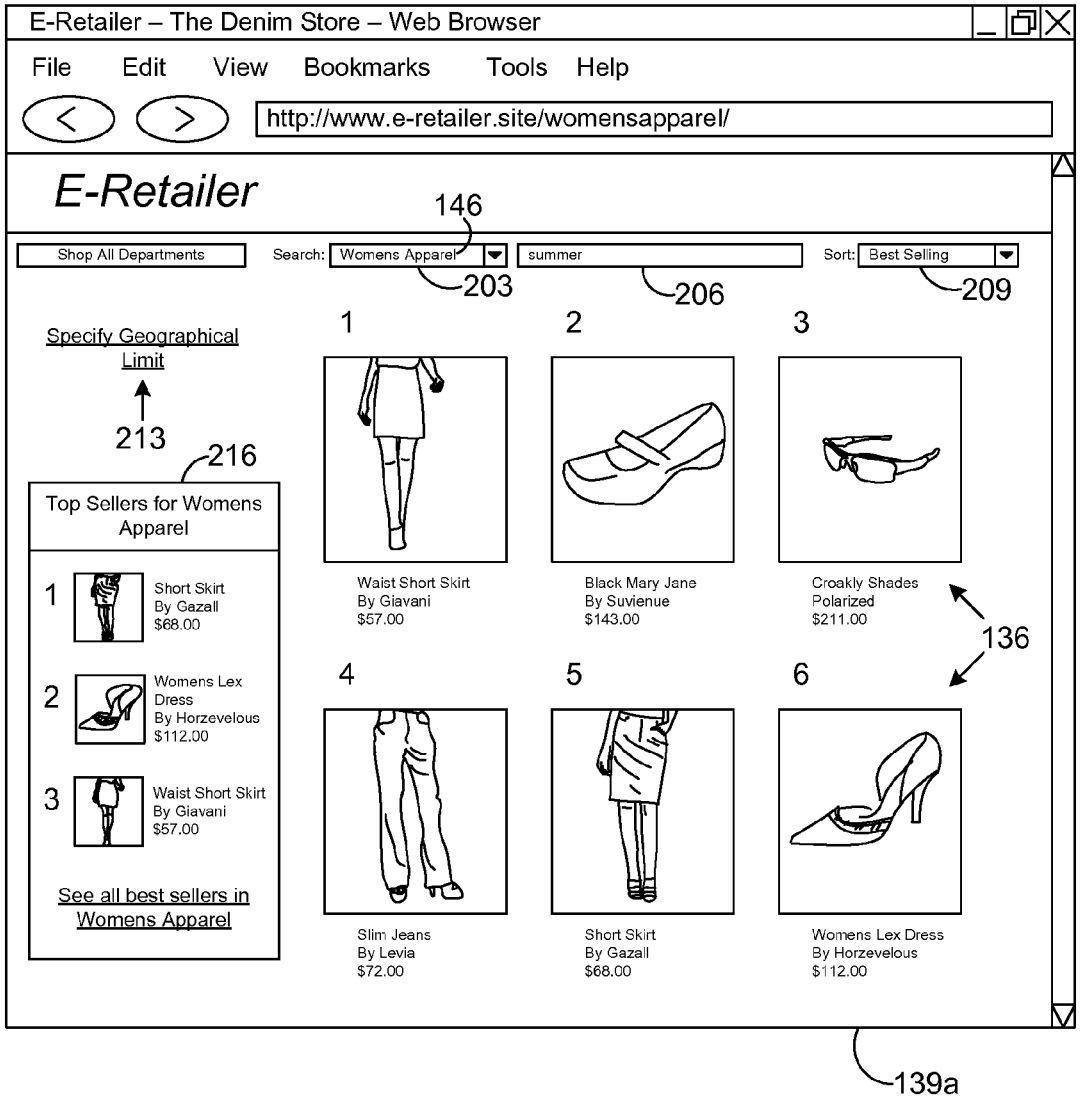
FIGS. 2-4 are drawings of examples of network pages and/or user interfaces rendered by a client in the networked environment of FIG. 1 according to various embodiments of the present disclosure.

Referring next to FIG. 2, shown is one example of the network page 139, denoted here as network page **139*a*, according to various embodiments. The network page 139*a* served up by the computing device 103 (FIG. 1) to the client device 106 (FIG. 1) in response to a request from the browser application 193 (FIG. 1). The network page 139*a* is generated in response to a search performed by the item search engine 125 (FIG. 1) in a specified item category 146 (FIG. 1) and depicts a number of representations of items 136 as shown. The network page 139*a* also includes a category selector 203, a search text box 206 and a sorting selector 209**.

The category selector 203 facilitates selection of one or more item categories 146 from which the customer wishes to view items 136. The item categories 146 may comprise part of a multilevel taxonomy and may appear at any level in the taxonomy. The item categories 146 facilitate narrowing down the number of items 136 to be viewed to the items 136 in the item catalog 143 that fall under the item category 146.

The search text box 206 allows the user to submit search terms to perform a search among the items 136 stored in the item catalog 143 to isolate those items 136 the customer wishes to view. The sorting selector 209 allows the customer to designate how to sort the items 136 that are responsive to a search entered into the search text box 206 and/or an item category 146 indicated in the category selector 203. The sorting selector 209 may present various options such as, for example, sorting the items 136 in terms of price such as the highest to lowest or lowest to highest. Also, such items 136 may be sorted according to sales velocity for the items 136 from the best selling to the worst selling. Still further, a user may select a "customer review" option in the sorting selector 209 that sorts the items 136 in accordance with their rankings as determined from customer reviews of such items 136 in association with the purchase of such items 136 in the past. Still further, there may be other ways of sorting the items 136 in the sorting selector 209. To this end, the sorting selector 209 comprises a pick list of several different sorting options that may be selected by a user to sort the items 136 as desired.

In addition, the network page **139*a* includes a geographical limit specification link 213 that allows the user to select one or more geographical areas that may be further used to limit the items 136 that are shown in the network page 139*a*. Upon manipulation of the geographical limit specification link 213, a request is sent to the electronic commerce system 123 for a user interface that may be presented in terms of a subsequent network page 139 (FIG. 1), a pop-up window, a light box, or other rendering presented on the display device 186 (FIG. 1**) as can be appreciated.

Further, the network page **139*a* may also include a best sellers list 216 that lists the top selling items 136 within the specified item category 146** as shown.

Figure 3:
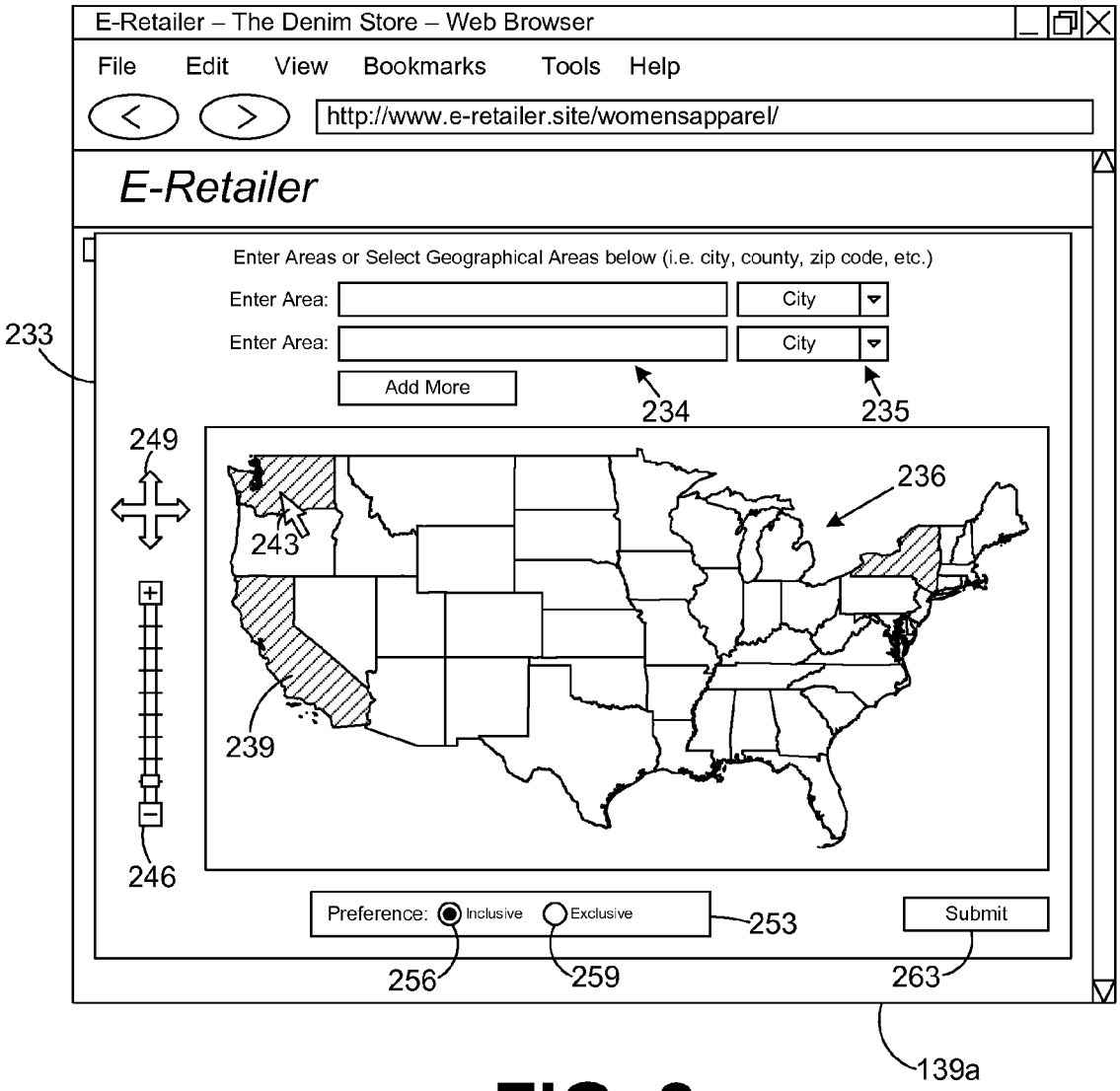

Referring next to FIG. 3, shown is an example of the network page **139*a* that includes a light box 233 superimposed over the network page 139***a* that presents a user interface to facilitate the specification of one or more geographical areas to be used to identify a subset of the items 136 to display in the network page 139*a* as described above. Although the user interface is presented in the form of the light box 233, it is understood that the same may be expressed in other forms such as, for example, a pop-up window, a drop-down box, a subsequent network page, or other form.

The light box 233 includes fields 234 in which a user may specify geographical areas such as cities, states, counties, zipcodes, townships, or other areas. Associated with each field 235 is a drop down box 235 to indicate the type of area specified. The geographical filtering process 126 may include a function to verify the validity of any entries in the fields 234.

The light box 233 also includes a map 236 with geographical areas 239 that may be selected by moving a cursor 243 and clicking on or otherwise selecting the respective geographical areas 239 as can be appreciated. In addition, the light box 233 includes a zoom mechanism 246 that facilitates zooming in and out of the map 236 to illuminate subordinate areas that appear when the view of the map 236 is restricted to smaller areas. To this end, the geographical areas 239 are shown as the United States of America. However, using the zoom mechanism 246, a user may examine specific cities, counties, zip code areas, municipalities, or other designated areas of the map 236.

The geographical areas 239 shown may be selected by clicking on such geographical areas 239 using the cursor 243 or via some other approach. For example, if the zoom mechanism 246 is manipulated such that individual zip codes are shown on the map 236, then the user may select the individual zip codes as the geographical area(s) 239. Thus, the granularity of the geographical areas 239 displayed depends upon a setting of the zoom mechanism 246. In addition, a scroll mechanism 249 is provided to allow a user to move the map in an upward, downward, or side-to-side direction as can be appreciated in order to view specific geographical areas 239 for selection as can be appreciated. Thus, both the zoom mechanism 246 and the scroll mechanism 249 allow a user to identify very specific geographical areas 239 that are predefined on the map 236.

Alternatively, geographical areas 239 may be defined in some other way. For example, an area may be defined by drawing a box, circle, or other shape with a cursor 243 on a location of the map 236. Still further, an area may be identified by drawing a freeform shape around an area to define a geographical area 239. Still further, the geographical areas 239 may be specified by identifying a point on the map 236 and inputting a radius, thereby specifying a circle having the input radius centered on the point. There may be many other way of determining a geographical area 239 on a map 236 as can be appreciated.

In addition, the light box 233 includes a preference box 253 in which a customer can identify whether the geographical areas 239 identified are to be included or excluded for consideration as described above. To this end, in defining a geographical area 239 for purposes of limiting the items 136 viewed, one may actually select one or more areas and then indicate that the ultimate area for consideration includes the selected geographical areas 239 by selecting on the "inclusive" toggle 256. Alternatively, a user may click on the "exclusive" toggle 259 to indicate that the geographical area to be considered is all area on the map 236 excluding any selected geographical areas 239. In such case, the geographical area to be considered would include all unselected geographical areas taken together as a single area.

Thus, one may define the ultimate geographical area 239 to be considered as including selected geographical areas 239 or excluding selected geographical areas 239. When a given geographical area 239 is selected, according to one embodiment, the appearance of such geographical area 239 may be configured to change using shading or other approaches so that it is clear which geographical areas 239 have been selected.

Assuming that all selections in the map 236 and the preference box 253 have been made, then the customer may click on or otherwise manipulate the submit button 263 to submit the one or more geographical areas 239 specified to the electronic commerce system 123 (FIG. 1). Thereafter, the electronic commerce system 123 uses the specified one or more geographical areas 239 to identify a subset of the items 136 in the item catalog 143 to display in the network page 139*a* given other limitations such as a selected item category 146 or search terms in the search text box 206 (FIG. 2).

In addition, once the submit button 263 is manipulated, the light box 233 may disappear to revert back to the previous view of the network page 139*a*. In one embodiment, the selected geographical areas 239 may be listed with toggle selectors so that a user can select or deselect a given geographical area 239 in order to determine whether such geographical areas 239 are to be used to filter the items 136. Once the electronic commerce system 123 identifies a subset of items 136 using the one or more geographical areas 239 specified, then it sends the listing of such items 136 to the client device 106 (FIG. 1) for display as a part of the network page 139*a*. This process may be repeated if a geographical area 239 is selected or deselected as mentioned above.

In order to use the geographical area 239 to identify the subset of items 136, the geographical filtering process 126 may examine the sales data 153 to identify the items 136 sold in one or more geographical areas 239. Thus, the geographical areas 239 may be employed to limit the items 136 that are viewed by a user in the network page 139*a* based on the purchasing habits of other customers in such geographical areas 239.

Figure 4:
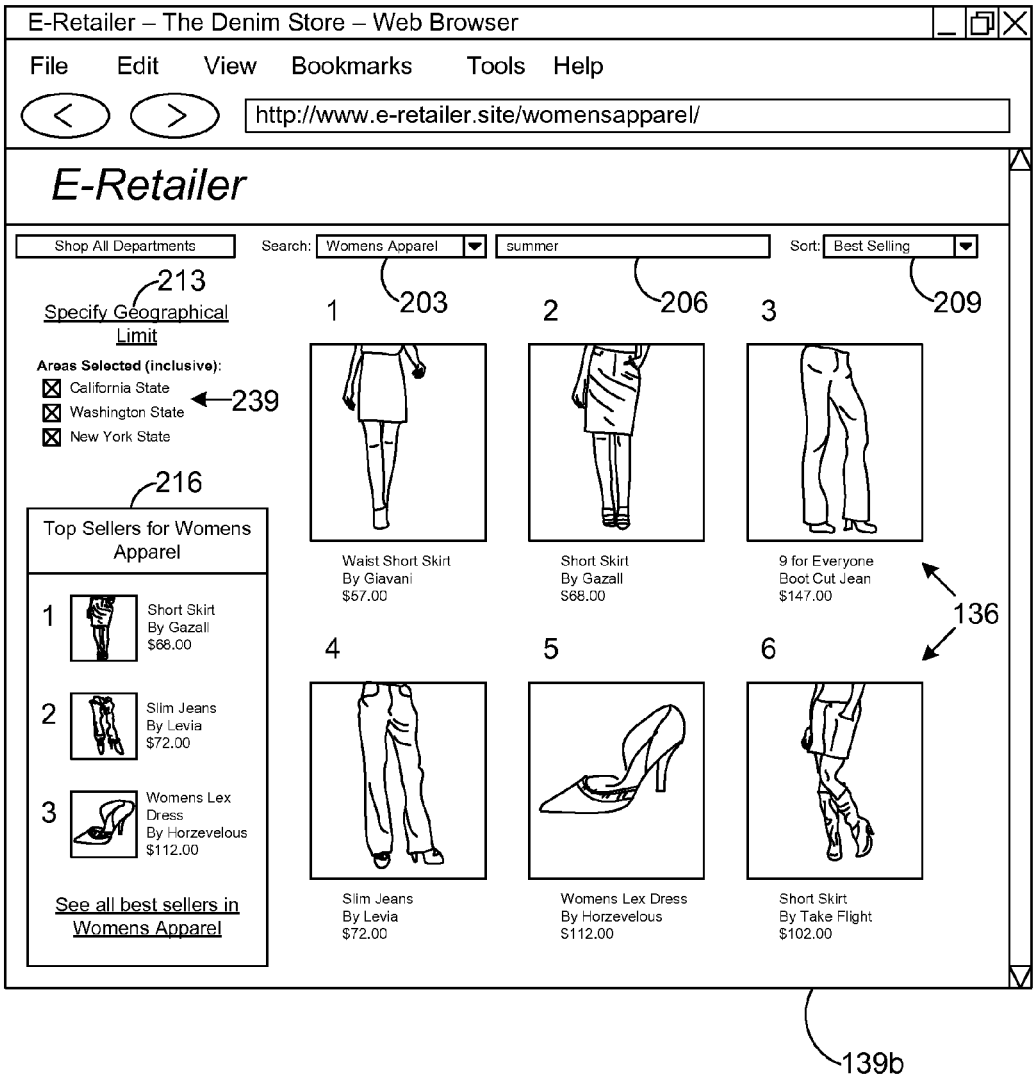

With reference to FIG. 4, shown is another example of a network page 139, denoted herein as network page 139*b*, according to various embodiments. The network page 139*b* includes a listing of previously selected geographical areas 239 that were selected as identified above with respect to FIG. 3. Accordingly, the items 136 depicted comprise a subset of the items 136 in the item catalog 143 (FIG. 1) that have some sort of predefined relationship with the one or more geographical areas 239. According to one embodiment, the predefined relationship may comprise the fact that such items 136 were the subject of commercial transactions that occurred at least partly in the one or more geographical areas 239. For example, such items 136 may have been shipped to such geographical areas 239 or the billing address of the purchasers may be located in such geographical areas 239, or both may be true. In addition, the predefined relationship between respective items 136 and a geographical area 239 may be defined in some other manner.

By virtue of the fact that the sorting selector 209 is included in the network page 139*b*, a user may sort the items 136 displayed according to the criteria included within the sorting selector 209. For example, given that the sorting selector 209 allows the user to rank the items 136 from the best selling to the worst selling as described above, then the user may isolate a set of top selling items within a given geographical area 239. Alternatively, where the recommendations engine 133 generates recommendations for a customer, or where the similarities engine 129 identifies similar products for those identified by a customer, such recommendations and similarities may be identified from those items 136 that have been identified as having a predefined relationship with the geographical areas 239 described above.

Alternatively, the listing of best sellers 216 within a given item category 146 may be generated based upon the geographical areas 239 selected in a similar manner. That is to say, the best sellers 216 are identified from those items 136 that are sold within the one or more specified geographical areas 239, where the quantities sold in such geographical areas 239 will determine where such items 136 rank relative to each other. Given that the network page 139*b* includes a listing of items 136 and the listing of best sellers 216, the geographical filtering process 126 generates two separate subsets or listing of items 136 to populate these two separate sections of the network page 139*b*.

Figure 5:
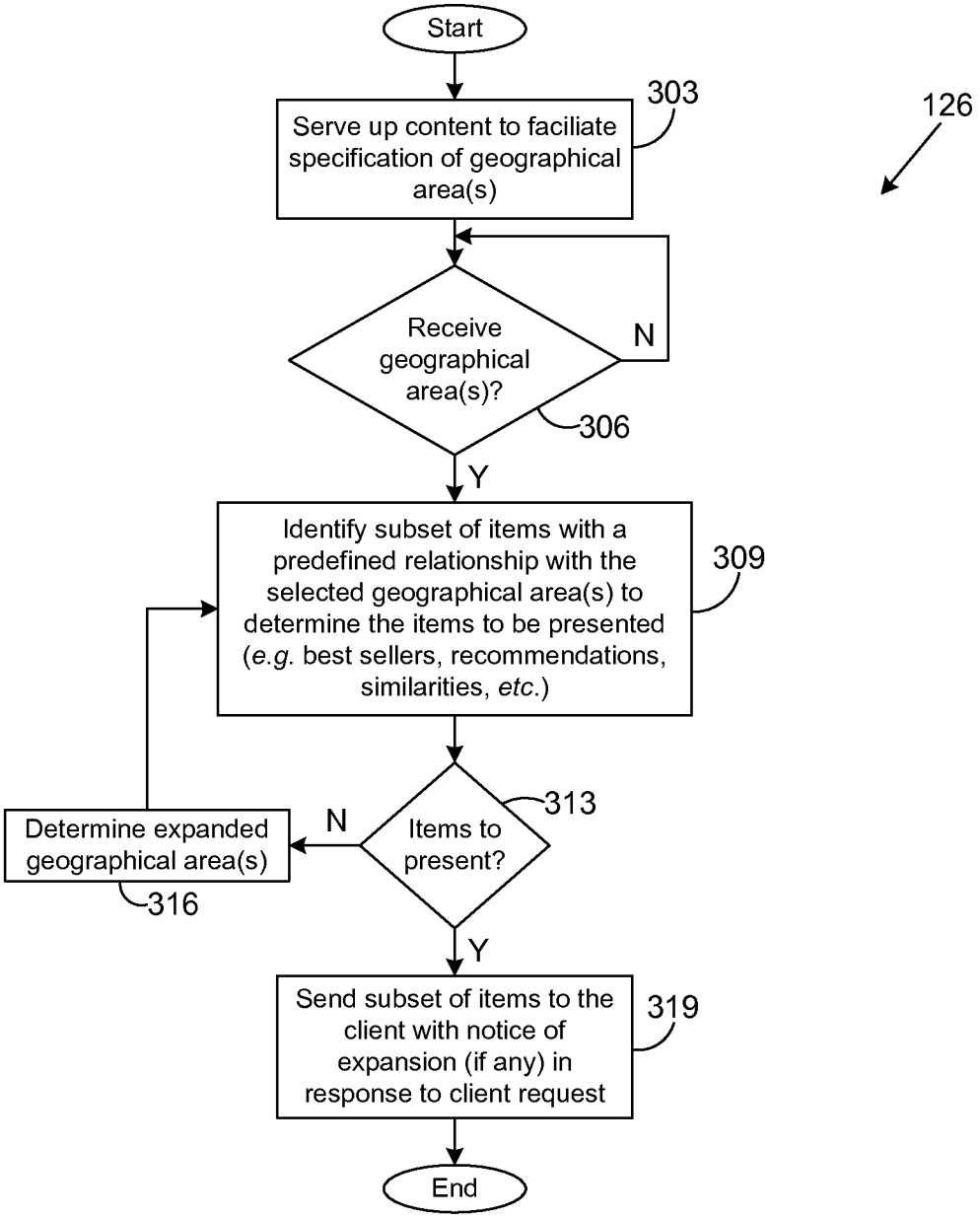
FIG. 5 is a flowchart illustrating one example of functionality implemented as portions of a geographical filtering process executed in a computing device in the networked environment of FIG. 1 according to various embodiments of the present disclosure.

Referring next to FIG. 5, shown is a flowchart that provides one example of the operation of a portion of the geographical filtering process 126 according to various embodiments. It is understood that the flowchart of FIG. 5 merely provides an example of the many different types of functional arrangements that may be employed to implement the operation of the portion of the geographical filtering process 126 as described herein. As an alternative, the flowchart of FIG. 5 may be viewed as depicting an example of steps of a method implemented in the computing device 103 (FIG. 1) according to one or more embodiments.

Beginning with box 303, the geographical filtering process 126 serves up content such as a user interface and other content that may be presented to a user to facilitate the specification of one or more geographical areas 239 (FIG. 3) that may be used to limit or filter the items 136 (FIG. 1) viewed in the network page 139 as mentioned above. For example, the content may comprise the user interface in the form of the light box 233 (FIG. 3) as described above or such content may be embodied in some other manner such as in a subsequent network page, a pop-up window, or other approach. Thereafter, in box 306 the geographical filtering process 126 waits to receive the specified geographical areas 239 from the client device 106 (FIG. 1). Then, in box 309, the geographical filtering process 126 identifies a subset of the items 136 in the item catalog 143 (FIG. 1) that have a predefined relationship with the selected geographical areas 239 (FIG. 3) to identify those items 136 that are to be presented to the user in a network page 139 as described above. The predefined relationship may be any such relationship as described above. Such items 136 may be presented in terms of items 136 responsive to a search, best sellers, recommendations, similarities, or such items 136 may be presented in some other manner. In one embodiment, such items 136 may be presented merely to show the items 136 in the item category 146 (FIG. 1) that have the predefined relationship with the selected geographical areas 239. Further, by manipulating the sorting selector 209, a user may cause the items 136 shown to be listed in a given order as described above.

Next, in box 313, the geographical filtering process 126 determines whether there are any items 136 to send to the client device 106. This is done because it may be the case that, once a geographical filter is applied in box 309, there may be no items 136 identified. If no items 136 are found, then in one embodiment, the geographical filtering process 126 proceeds to box 316 to expand the geographical areas 239 selected. In one embodiment, the expansion may be done by including geographical areas 239 adjacent to one of the selected geographical areas 239, or the expansion may occur in some other manner as can be appreciated. In another embodiment, the geographical filtering process 126 may omit boxes 313 and 316 and simply reply that no items 136 were identified rather than automatically expand the geographical areas 239 to be considered. In such a case, the geographical filtering process 126 may present a link or other graphical component that allows a user to manually expand the geographical areas 239 to be considered.

Assuming that the geographical areas 239 were expanded in box 316, then the geographical filtering process 126 reverts back to box 309 to filter the items 136 as described above based upon the newly identified geographical areas 239.

However, assuming that there are items 136 to present as determined in box 313, then the geographical filtering process 126 proceeds to box 319 to send the new subset of items 136 to the client device 106 in response to the initial request from the client device 106. If any expansion of the specified geographical areas 239 has occurred, then a notice may be included in the response indicating such expansion to the client device 106 for viewing by user on the display device 186 (FIG. 1). Thereafter the geographical filtering process 126 ends as shown.

Figure 6:
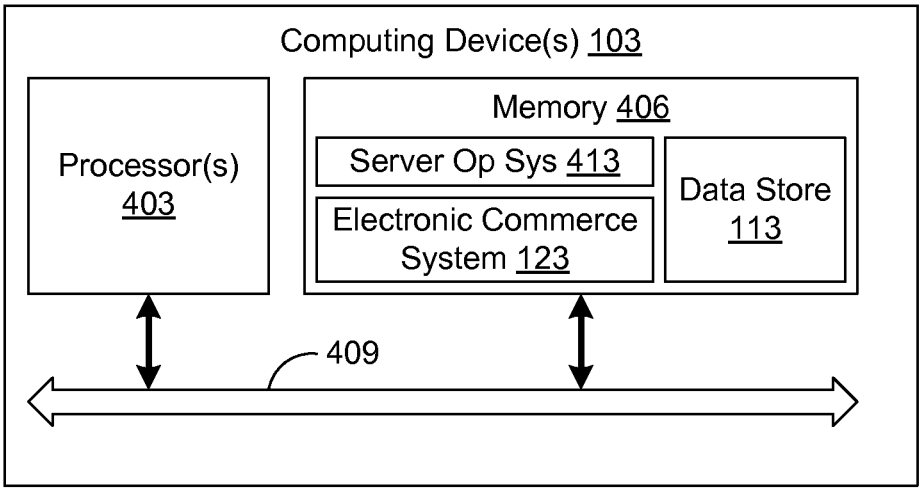
FIG. 6 is a schematic block diagram that provides one example illustration of a computing device employed in the networked environment of FIG. 1 according to various embodiments of the present disclosure.

With reference to FIG. 6, shown is a schematic block diagram of the computing device 103 according to an embodiment of the present disclosure. The computing device 103 includes at least one processor circuit, for example, having a processor 403 and a memory 406, both of which are coupled to a local interface 409. To this end, the computing device 103 may comprise, for example, at least one server computer or like device. The local interface 409 may comprise, for example, a data bus with an accompanying address/control bus or other bus structure as can be appreciated.

Stored in the memory 406 are both data and several components that are executable by the processor 403. In particular, stored in the memory 406 and executable by the processor 403 are the electronic commerce system 123 including the geographical filtering process 126 and other engines, applications, and components as described above. Also stored in the memory 406 may be a data store 113 and other data. In addition, an operating system may be stored in the memory 406 and executable by the processor 403.

It is understood that there may be other applications that are stored in the memory 406 and are executable by the processors 403 as can be appreciated. Where any component discussed herein is implemented in the form of software, any one of a number of programming languages may be employed such as, for example, C, C++, C#, Objective C, Java, Java Script, Perl, PHP, Visual Basic, Python, Ruby, Delphi, Flash, or other programming languages.

A number of software components are stored in the memory 406 and are executable by the processor 403. In this respect, the term "executable" means a program file that is in a form that can ultimately be run by the processor 403. Examples of executable programs may be, for example, a compiled program that can be translated into machine code in a format that can be loaded into a random access portion of the memory 406 and run by the processor 403, source code that may be expressed in proper format such as object code that is capable of being loaded into a random access portion of the memory 406 and executed by the processor 403, or source code that may be interpreted by another executable program to generate instructions in a random access portion of the memory 406 to be executed by the processor 403, etc. An executable program may be stored in any portion or component of the memory 406 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 406 is defined herein as including both volatile and nonvolatile memory and data storage components. Volatile components are those that do not retain data values upon loss of power. Nonvolatile components are those that retain data upon a loss of power. Thus, the memory 406 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 403 may represent multiple processors 403 and the memory 406 may represent multiple memories 406 that operate in parallel processing circuits, respectively. In such a case, the local interface 409 may be an appropriate network that facilitates communication between any two of the multiple processors 403, between any processor 403 and any of the memories 406, or between any two of the memories 406, etc. The local interface 409 may comprise additional systems designed to coordinate this communication, including, for example, performing load balancing. The processor 403 may be of electrical or of some other available construction.

Although electronic commerce system 123 that includes the geographical filtering process 126 and other various systems described herein may be embodied in software or code executed by general purpose hardware as discussed above, as an alternative, the same may also be embodied in dedicated hardware or a combination of software/general purpose hardware and dedicated hardware. If embodied in dedicated hardware, each component can be implemented as a circuit or state machine that employs any one of or a combination of a number of technologies. These technologies may include, but are not limited to, discrete logic circuits having logic gates for implementing various logic functions upon an application of one or more data signals, application-specific integrated circuits having appropriate logic gates, or other components, etc. Such technologies are generally well known by those skilled in the art and, consequently, are not described in detail herein.

The flowchart of FIG. 5 shows the functionality and operation of an implementation of at least a portion of the geographical filtering process 126. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 403 in a computer system or other system. The machine code may be converted from the source code, etc. If embodied in hardware, each block may represent a circuit or a number of interconnected circuits to implement the specified logical function(s).

Although the flowchart of FIG. 5 shows a specific order of execution, it is understood that the order of execution may differ from that which is depicted. For example, the order of execution of two or more blocks may be scrambled relative to the order shown. Also, two or more blocks shown in succession in FIG. 5 may be executed concurrently or with partial concurrence. Further, in some embodiments, one or more of the blocks shown in FIG. 5 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the electronic commerce system 123, and more particularly, the geographical filtering process 126, that comprises software or code can be embodied in any non-transitory computer-readable medium for use by or in connection with an instruction execution system such as, for example, a processor 403 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A non-transitory computer-readable medium embodying a program executable in a computing device, comprising:

code that maintains a relationship between each of a plurality of items and a respective geographical area, each relationship being defined based at least in part upon a degree to which customers associated with the respective geographical area interact with one of the plurality of items in an electronic commerce system;

code that generates an interface that facilitates a specification of at least one selected geographical area in response to a request from a client device;

code that sends the interface to the client device in response to the request to obtain the specification of the at least one selected geographical area from the client device;

code that determines a subset of the items in an item catalog, the subset of the items comprising top selling ones of the items within a predefined item category within the at least one selected geographical area, and recommended ones of the items that have been sold within the at least one selected geographical area;

code that sends a listing of the top selling ones of the items to the client device to be rendered on a display device associated with the client device; and wherein the interface facilitates the specification of the at least one selected geographical area by facilitating a selection of at least one area on a map, and wherein the interface facilitates a selection of whether the at least one selected geographical area is inside the at least one area.

2. The non-transitory computer-readable medium of claim 1, wherein the interaction with one of the plurality of items over the electronic commerce system comprises viewing the one of the plurality of items by the customers.

3. The non-transitory computer-readable medium of claim 2, wherein a customer is associated with the respective geographical area based on an internet protocol address associated with the customer.

4. The non-transitory computer-readable medium of claim 1, wherein the interface comprises a network page, a pop-up window, a light box, or a drop-down box.

5. The non-transitory computer-readable medium of claim 1, wherein the map includes a plurality of areas of varying sizes.

6. The non-transitory computer-readable medium of claim 1, wherein the interface facilitates a selection of a plurality of selected geographical areas.

7. A method, comprising the steps of:

rendering an interface in a computing device, the interface facilitating a specification of at least one geographical area;

receiving via the interface the specification of the at least one geographical area; and rendering a listing of a subset of a plurality of items in a display device associated with the computing device, the subset of items comprising at least a plurality of recommended items that have been sold within the at least one geographical area, wherein the subset of the plurality of items is determined based at least in part upon whether each item in the subset of the plurality of items has a relationship with the at least one geographical area, each relationship being defined based on a shipping address associated with past commercial transactions associated with the items in the subset.

8. The method of claim 7, wherein each relationship is further defined based on a billing address associated with a past commercial transaction regarding one of the plurality of items.

9. The method of claim 7, wherein the at least one geographical area comprises at least one selected area.

10. The method of claim 7, wherein the listing of the subset of the items further comprises a listing of best-selling items inside the at least one geographical area.

11. The method of claim 7, wherein the at least one geographical area comprises an area outside at least one selected area.

12. The method of claim 7, wherein the listing of the subset of the items further comprises a listing of best-items outside the at least one geographical area.

13. The method of claim 7, wherein the interface facilitates a specification of a preference associated with the at least one geographical area, the method further comprising receiving, via the interface, a selection of the specification of the preference associated with the at least one geographical area, the preference indicating whether the at least one geographical area includes a selected area.

14. The method of claim 7, wherein the relationship is further defined based at least in part upon whether the items in the subset are included in at least one virtual shopping cart associated with at least one user, the at least one user being associated with the at least one geographical area.

15. The method of claim 7, wherein the relationship is further defined by whether the items in the subset have been viewed at least a threshold number of times by at least one user, the at least one user being associated with the at least one geographical area.

16. The method of claim 7, wherein the subset of items comprises a set of top selling items within the at least one geographical area.

17. The method of claim 7, wherein the subset of items comprises a set of recommended items within the at least one geographical area.

18. The method of claim 7, further comprising the steps of:

sending the specification of the at least one geographical area from the computing device to a server over a network; and receiving the listing of the subset of the plurality of items in the computing device from the server over the network.

19. The method of claim 7, further comprising the steps of:

sending a request for the interface from the computing device to a server over a network; and receiving the interface in the computing device from the server over the network.

20. A system, comprising:

at least one computing device;

a catalog of items stored in a data store accessible by the at least one computing device; and a geographical filtering process executable in the at least one computing device, the geographical filtering process comprising:

logic that obtains a specification of at least one geographical area;

logic that identifies a subset of the items based at least in part upon a plurality of past commercial transactions associated with the items occurring within the at least one geographical area, and based at least in part upon recommended ones of the items that have been sold within the at least one geographical area; and logic that determines whether the past commercial transactions associated with the items occur within the at least one geographical area by determining whether the items have been viewed at least a threshold number of times by at least one user, the at least one user being associated with the at least one geographical area.

21. The system of claim 20, wherein the logic that identifies the subset of the items based at least in part upon the plurality of past commercial transactions associated with the items occurring within the at least one geographical area further comprises logic that identifies top selling ones of the items within the at least one geographical area.

22. The system of claim 21, wherein top selling ones of the items are identified in a predefined category of items.

23. The system of claim 20, wherein the logic that obtains the specification of the at least one geographical area further comprises logic that generates an interface that facilitates an input of the at least one geographical area in a client device.

24. The system of claim 23, wherein the logic that obtains the specification of the at least one geographical area further comprises:

logic that sends the interface to the client device over a network; and logic that receives the at least one geographical area from the client device.

25. The system of claim 20, wherein the geographical filtering process further comprises logic that expands the at least one geographical area if no subset of items can be identified.

26. The system of claim 20, wherein the at least one geographical area is expanded when the identified subset of items includes less than a threshold number of items.

27. The system of claim 20, wherein the geographical filtering process further comprises logic that determines whether the past commercial transactions associated with the items occurred within the at least one geographical area by determining a degree to which customers associated with the at least one geographical area interacted with one of the items in an electronic commerce system , wherein the interaction with one of the items over the electronic commerce system comprises storing the one of the items in a user list

28. The system of claim 27, wherein the interaction with one of the items over an electronic commerce system comprises storing the one of the items in a user list.

29. The system of claim 20, wherein the geographical filtering process further comprises logic that determines whether the past commercial transactions associated with the items occurs within the at least one geographical area by determining whether billing addresses associated with the past commercial transactions are located in the at least one geographical area.

* * * * *

UNITED STATES PATENT AND TRADEMARK OFFICE

CERTIFICATE OF CORRECTION

PATENT NO. : 8,433,625 B1
APPLICATION NO. : 12/816405
DATED : April 30, 2013
INVENTOR(S) : Subramonia P. Sarma It is certified that error appears in the above-identified patent and that said Letters Patent is hereby corrected as shown below:

In the Drawings

Formal Drawings, Sheet 1, Fig. 1, change “Catgories” to --Categories--

In the Specification

Column 7, line 12, delete the first occurrence of “235” and replace with --234--

In the Claims

Column 16, line 5, change “system ,” to --system,--

Column 16, line 7, change “list” to --list.--

Signed and Sealed this
Twelfth Day of August, 2014

Michelle K. Lee

Michelle K. Lee
*Deputy Director of the United States Patent and Trademark Office*